US005195677A

United States Patent [19]

Quintana et al.

[11] Patent Number: 5,195,677

[45] Date of Patent: Mar. 23, 1993

[54] HOOD AND TRAY CARTON AND BLANKS FOR FORMING SAME

[75] Inventors: Terry J. Quintana; Stephen J. Balderson, both of Des Moines, Iowa

[73] Assignee: Tone Brothers, Inc., Des Moines, Iowa

[21] Appl. No.: 883,764

[22] Filed: May 15, 1992

[51] Int. Cl.[5] ..... B65D 13/00; B65D 5/64

[52] U.S. Cl. ..... 229/117.07; 229/125.32; 229/164

[58] Field of Search ..... 229/117.07, 125.32, 229/40, 23 BT, 23 R, 164

[56] References Cited

U.S. PATENT DOCUMENTS 2,106,907 2/1938 Brunt et al. ..... 229/125.32
2,295,515 9/1942 Hoag ..... 229/117.07
3,276,662 10/1966 Farquhar ..... 229/125.32
3,951,329 4/1976 Turner ..... 229/125.32
4,691,859 9/1987 Snyder ..... 229/23 R
5,016,753 5/1991 Henderson ..... 229/23 B T
5,076,491 12/1991 Freudentahl et al. ..... 229/125.32

FOREIGN PATENT DOCUMENTS 451992 10/1948 Canada ..... 229/40

*Primary Examiner*—Gary E. Elkins
*Attorney, Agent, or Firm*—Jacobson, Price, Holman & Stern

[57] ABSTRACT

A tray and a hood form a carton for shipment, storage and display of food products. The carton eliminates the need for strapping during shipment while at the same time providing adequate protection while in transit. Further, this packaging system provides consumers with a merchandise carry-out system.

16 Claims, 4 Drawing Sheets

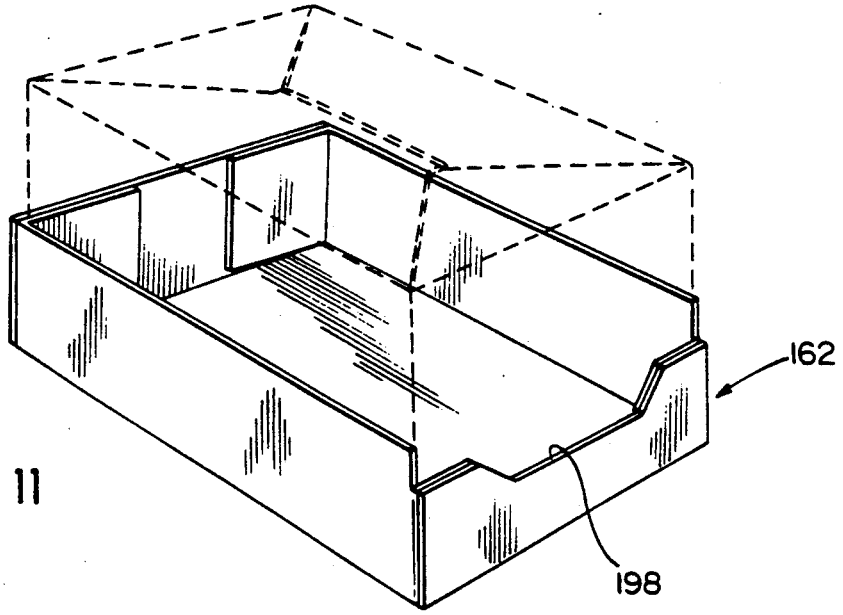
FIG. 11
FIG. 12
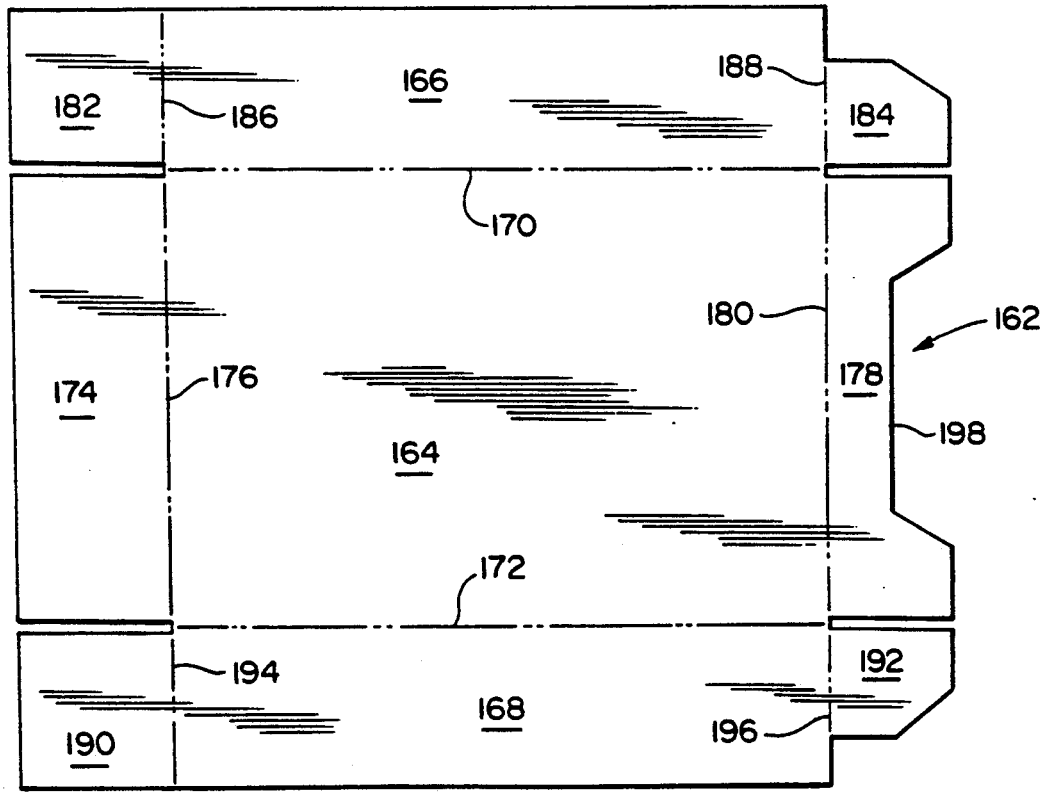

HOOD AND TRAY CARTON AND BLANKS FOR FORMING SAME

FIELD OF THE INVENTION

This invention relates to a carton made of a hood and a tray for shipping, storage and display of food products.

BACKGROUND OF THE INVENTION

Previous attempts to ship food products have included a hood and a tray that included plastic strapping that surrounded the formed carton during shipment. Upon delivery, the strapping is required to be cut, removed and disposed of since it has no other useful purpose.

During shipping, often times the strapping can indent into the outer surface of the carton and damage the carton and sometimes the product contained within. Also, strapping is often used where some of the product is exposed, creating a risk factor for product damage. Finally, the cut strapping present an environmental concern since the strapping is of a plastic material which requires specialized recycling procedures.

SUMMARY OF THE INVENTION

By the present invention, a tray and a hood form a carton for shipment, storage and display of food products. The carton eliminates the need for strapping during shipment while at the same time providing adequate protection while in transit. Further, this packaging system provides consumers with a merchandise carry-out system.

The tray and hood of the present invention are designed to form a box or carton which work as a unit, as well as work independently of each other. The tray serves as a display or consumer carry-out packaging when used alone. The hood is made with an interlocking design so that the hood can be used without the tray.

By the absence of plastic strapping, greater efficiency of material use is achieved with substantial time savings during production and shipping. The tray/hood combination totally covers and protects a product. Both the tray and hood are made of recyclable or reusable cardboard.

The tray/hood combination is easy for use by customers to unpack. There is no cutting of a plastic strap required with the inherent danger of cutting oneself.

When a customer receives a product shipped within the combined tray and hood, the hoods are removed and can be placed with previously emptied trays near an exit of the customer's place of business. Consumers can fill the previously empty trays with product and pick up a hood as they leave the place of business to form an easy to handle, heavy duty carton.

It is therefore an object of the present invention to provide a hood and tray blank which fold into a formed hood and a formed tray with the formed hood and formed tray interengaged to form a carton used for shipping and storing of food products. Upon removal of the hood, the tray serves as a display device for sale of the contained products.

It is an object of the present invention to provide a hood and tray and blanks for forming same with a hood and tray interengaging each other to form a carton.

It is another object of the present invention to provide a hood and tray and blanks for forming same with a hood and tray interengaging each other to form a carton with the hood being dimensioned to sit within the tray and the tray forming a display device upon removal of the hood.

It is yet another object of the present invention to provide a hood and tray and blanks for forming same with a hood and tray interengaging each other to form a carton for shipping and storage of products with the hood being dimensioned to sit within the tray and the tray forming a display device upon removal of the hood.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 11 is a perspective view of a alternate embodiment of a tray with a hood shown in dotted line for illustrative purposes.

FIG. 12 is a laid open view of a blank for the tray shown in FIG. 11.

DETAILED DESCRIPTION OF THE PREFERRED EMBODIMENTS

Figure 1:
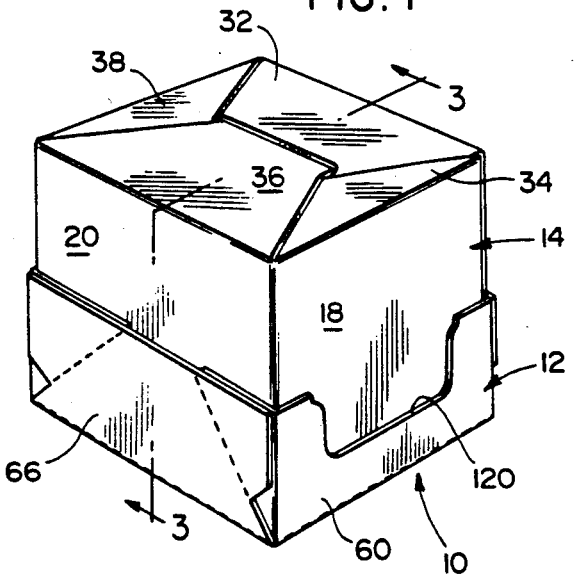
FIG. 1 is a perspective view of a carton formed from a tray and a hood of the invention.

In describing a preferred embodiment of the invention illustrated in the drawings, specific terminology will be resorted to for the sake in clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 7, in particular, a carton embodying the teachings of the subject invention is generally designated as 10. The carton 10, shown in FIG. 1 includes a tray 12 and a hood 14.

Figure 2:
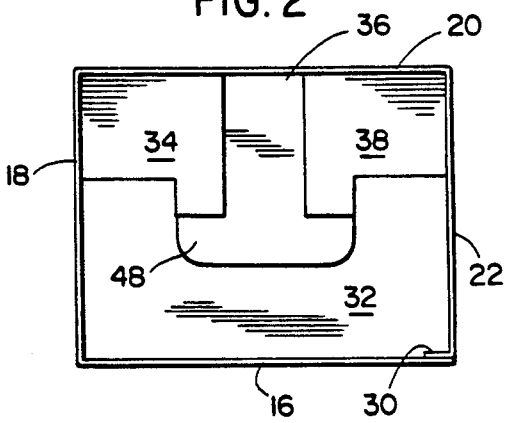
FIG. 2 is a bottom plan view of a folded hood.
Figure 3:
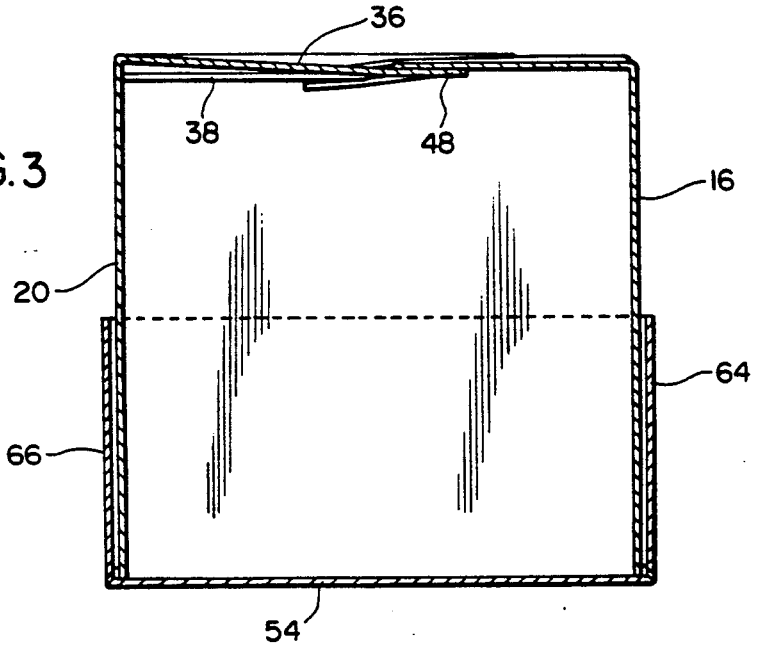
FIG. 3 is a sectional view taken along line 3-3 of FIG. 1.
Figure 5:
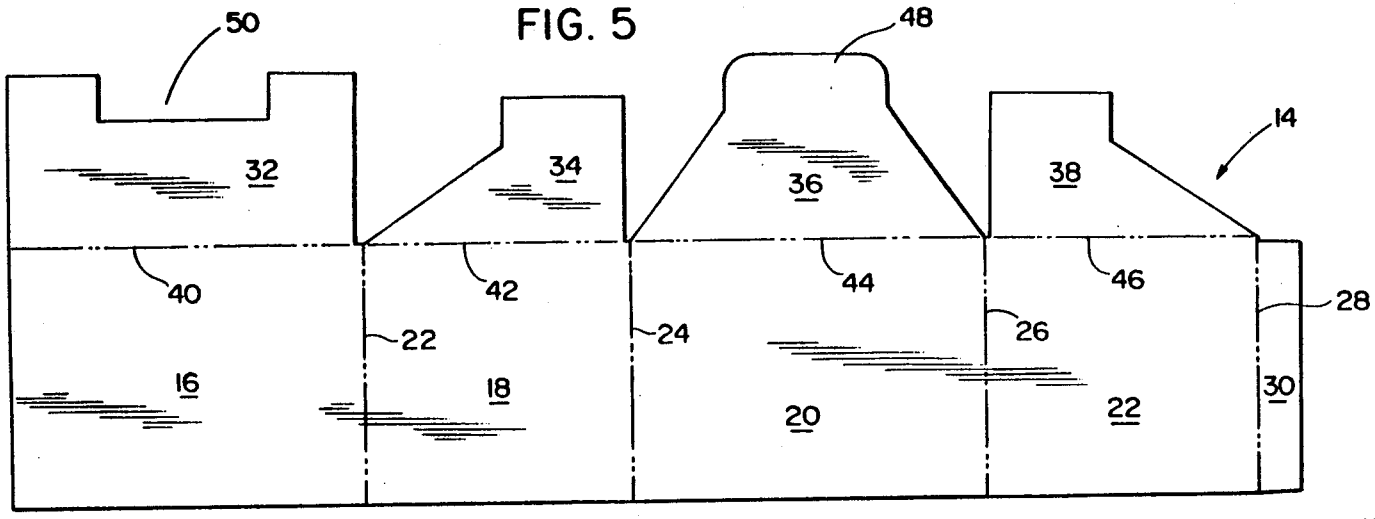
FIG. 5 is a laid open view of a blank for a hood.

As shown in FIG. 5, the hood 14 includes four panels 16, 18, 20 and 22 interconnected by fold lines 22, 24 and 26. Connected to panel 22 by fold line 28 is connection tab 30. An exterior surface of connection tab 30 is glued to an interior surface of panel 16 to form a rectangular shaped hood as shown in FIG. 2. Connected to panels 16, 18, 20 and 22 are closure flaps 32, 34, 36 and 38 by fold lines 40, 42, 44 and 46, respectively. Closure flap 36 includes a securing tab 48 on a side of the closure flap opposite to fold line 44.

As shown in FIG. 2, which is an interior view of the hood 14, the closed or top end of the hood is formed by first folding down flap 32 onto which flaps 34 and 38 are then folded. Flap 36 is then folded down onto flaps 34 and 38 so that the securing tab 48 passes underneath flap 32 by passing through a cutout portion 50 formed in flap 32.

Figure 6A:
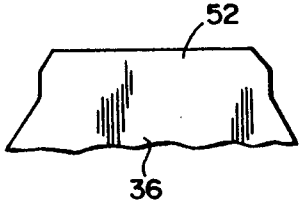
FIG. 6A is an alternate embodiment of a tab for a securing tab of a hood.

In FIG. 6A, an alternative securing tab 52 used with closure flap 36 is shown. Securing tab 52 is of a slightly different configuration than blank 48 for securing panel 36 in place.

Figure 7:
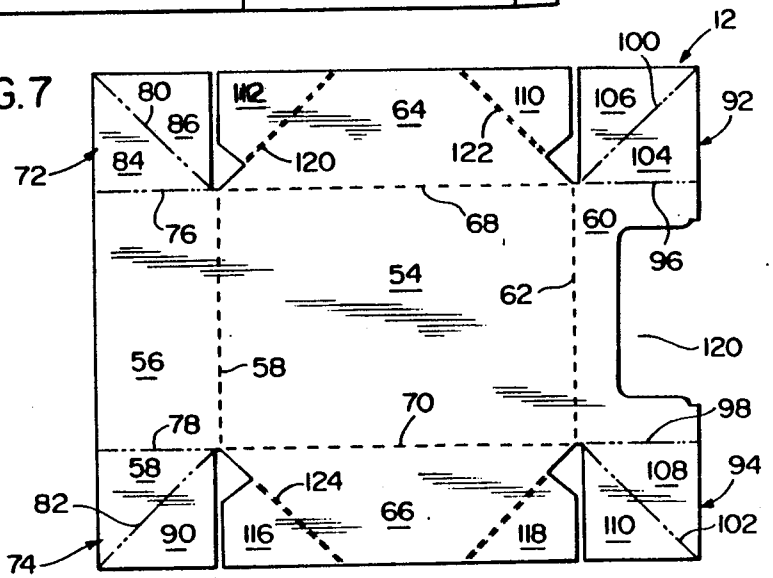
FIG. 7 is a laid open view of a blank for a tray.

The tray 12 is formed from a blank as shown in FIG. 7. The tray includes base panel 54 having rear panel 56 connected by fold line 58 to base panel 54 and front access panel 60 connected by fold line 62 to base panel 54. Side panels 64 and 66 are connected by fold lines 68 and 70, respectively, to base panel 54.

Figure 4:
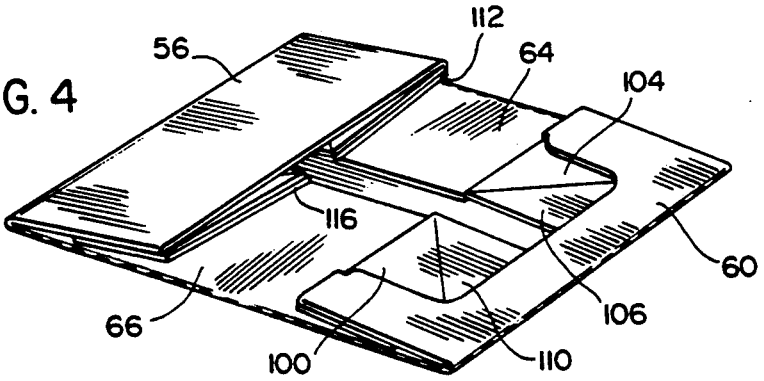
FIG. 4 is a perspective view of an assembled tray in a collapsed position.

Rear panel 56 includes square fold tabs 72, 74 connected to rear panel 56 by fold lines 76, 78, respectively. Each of the fold tabs 72, 74 includes a diagonal fold line 80, 82 which are used for the flattening of the assembled tray as shown in FIG. 4. The fold tabs 72, 74 are divided by fold lines 80, 82 into fold triangles 84, 86, 88 and 90, respectively.

Similarly, front access panel 60 includes fold tabs 92, 94 connected to the front access panel 60 by fold lines 96, 98, respectively. Each fold tab 92, 94 includes a diagonal fold line 100, 102, respectively, to divide fold tabs 92, 94 into triangular portions 104 and 106 and 108 and 110, respectively. Each of the side panels 64 and 66 include fold triangles 112, 114, 116 and 118, which are truncated triangles, having score lines 120, 122, 124 and 126, respectively.

To form tray 12, rear panel 56 and front access panel 60 are folded along dotted lines 58 and 62, respectively, towards base panel 154. Fold tabs 72, 74, 92 and 94 are then folded to be aligned parallel to fold lines 68 and 70. Side panels 64 and 66 are then folded inwardly toward base panel 54 along fold lines 68 and 70.

Figure 6B:
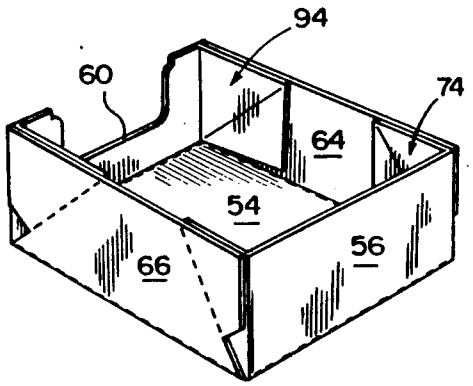
FIG. 6B is a rear perspective view of an assembled tray.

The inside surface of fold triangle 112 is then glued to the outside surface of fold triangle 84. Similarly, the inside surface of fold triangle 114 is glued to fold triangle 104, the inside surface of fold triangle 116 to the outside surface of fold triangle 88 and the inside surface of fold triangle 118 is glued to the outside exterior of fold triangle 108 to form a tray as shown in FIG. 6B.

For storage or shipping purposes, the tray is collapsible to a collapsed position as shown in FIG. 4. To facilitate the moving of the tray into the collapsed condition, the fold triangles 86, 90, 106 and 110 are bent along their respective fold lines 80, 82, 100 and 102 to allow collapse of the side walls 64 and 66. The rear panel 56 and front access 60 fold on top of the side panels 64, 66. The score lines 120, 122 and 124, 126 facilitate the collapse of the side panels 64, 66.

FIG. 1 illustrates an assembled hood and tray with the hood fit within the tray so that the lowermost edges of the hood contact the base panel 54 of the tray. Goods contained within the tray and covered by the hood are shipped and stored in the combined hood and tray. Products contained in pint, quart and half-gallon size containers may be contained within a appropriately sized hood and tray combination as shown in FIG. 1.

For display purposes, the hood 14 is removed to allow products to project above the top of the tray 12. A cut-out portion 120 of front access panel 60 allows a view of the contents of the tray and whatever labelling may be on the contained product. This assists the consumer in the display of the product.

Figure 8:
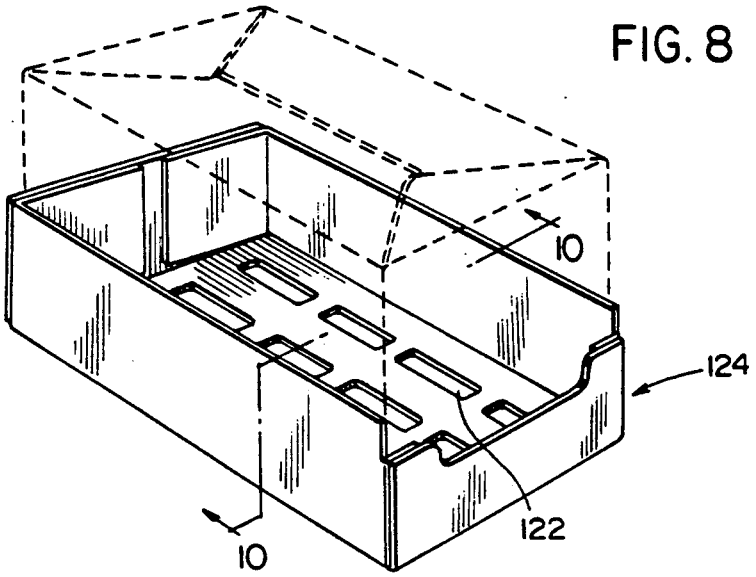
FIG. 8 is a perspective view of an alternate embodiment of a tray with a hood shown in dotted lines for illustrative purposes.
Figure 9:
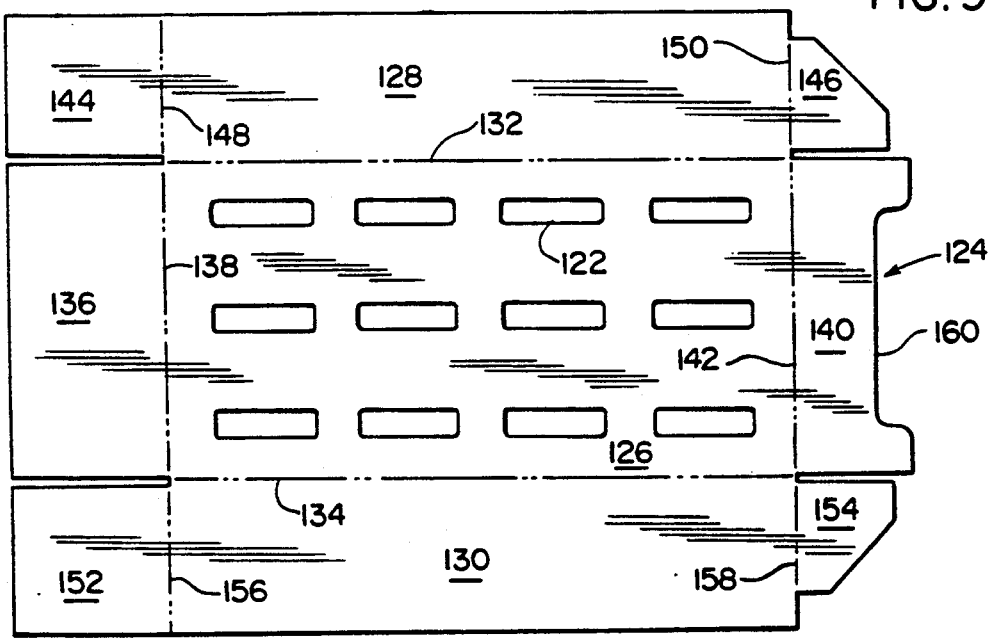
FIG. 9 is a laid open view of a blank for the tray shown in FIG. 8.
Figure 10:
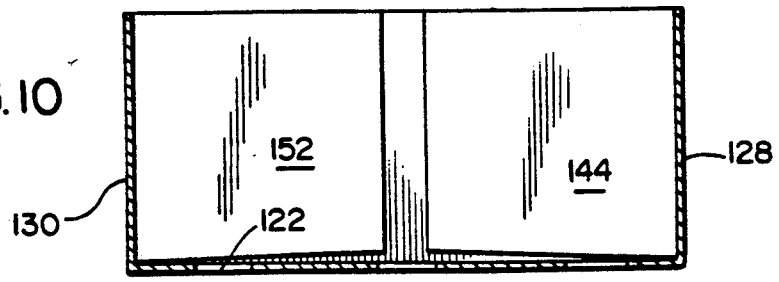
FIG. 10 is sectional view taken along line 10—10 of FIG. 8.

In FIGS. 8 through 10 and in FIGS. 11 and 12, two alternate forms of trays and their respective blanks are shown. In FIGS. 8 and 9, the elongated rectangular openings 122 formed in the trays 124 are for purposes of scanning of SKU labels located on the bottom of a product contained within the tray 124.

In FIG. 9, tray 124 includes a rectangular base panel 126 having side panels 128 and 130 connected by fold lines 132 and 134, respectively. Rear panel 136 is connected to base panel 126 by fold line 138. A front access panel 140 is connected to base panel 126 by fold line 142. The front access panel is of an overall height less than the height of the side panels and the rear panel.

The side panels 128, 130 include connecting tabs 144, 146 connected by fold lines 148, 150, respectively, and connecting tabs 152, 154 connected by fold lines 156, 158, respectively. The connecting tabs are secured to the inside of the rear panel 136 and front access panel 140 to form an upright tray 124 as shown in FIG. 8. An access cut-out 160 is removed from the front access panel 140 for display purposes. A hood used in combination with tray 124 is of a construction similar to that shown for hood 14.

In FIGS. 11 and 12, a tray 162 includes a base panel 164 with side panels 166, 168 connected by fold lines 170, 172, respectively. A rear panel 174 is connected to base panel 164 by fold line 176. Similarly, front access panel 178 is connected by fold line 180 to base panel 164. The side panels 166, 168 include connecting tabs 182, 184 connected by fold lines 186, 188, respectively, and connecting tabs 190, 192 connected by fold lines 194, 196, respectively.

In the assembled form, as shown in FIG. 11, the connecting tabs are folded interiorly of the rear panel 174 and front access panel 178 and secured to rear panel 174 and front access panel 178 to form an upright tray as shown in FIG. 8. An access slot 198 has been removed from front access panel 178 for display of products contained within the tray 162. The front access panel is of an overall height less than the height of the side panels and the rear panel.

Having described the invention, many modifications thereto will become apparent to those skilled in the art to which it pertains without deviation from the spirit of the invention as defined by the scope of the appended claims.

We claim:

1. A carton comprising:

a hood, and a tray, said hood including four panels connected together and four closure flaps, one closure flap extending from a same side of each of said four panels, and a connection tab extending from a side edge of one of said four panels for joining opposite ends of said four panels together, said tray including a base panel and two side panels, a rear panel and a front access panel connected to said base panel and extending above said base panel to define an opening for receipt of a lowermost portion of said hood, said rear panel and said front access panel of said tray each include two fold tabs each secured to one of said two side panels.

2. A carton according to claim 1, wherein said front access panel includes a cut-out portion for access to an interior of the tray.

3. A carton according to claim 1, wherein said fold tabs include a diagonal fold line.

4. A carton according to claim 3, wherein said two side panels include diagonal score lines.

5. A carton according to claim 4, wherein a triangular portion of said fold tabs is secured to a triangular portion of said side panels.

6. A carton according to claim 5, wherein said triangular portion of said side panels is a truncated triangular portion.

7. A carton according to claim 5, wherein said tray is movable to a collapsed position.

8. A carton according to claim 1, wherein a height of said two side panels, said rear panel and said front access panel is the same.

9. A carton according to claim 1, wherein a height of said front access panel is less than a height of said two side panels and said rear panel.

10. A carton according to claim 1, wherein said closure flaps are folded to form a cover for said tray.

11. A carton for shipping, storing and displaying products, said carton comprising:

a hood, and a tray, said hood including four panels connected together and four closure flaps, one closure flap extending from a same side of each of said four panels, and a connection tab extending from a side edge of one of said four panels for joining opposite ends of said four panels together, said tray including a base panel with two side panels, a rear panel and a front access panel secured together and projecting above said base panel, said hood being inserted within said tray to cover any products located on said tray, a lowermost portion of said hood contacting said base panel of said tray and covering an opening of said front access panel, said closure flaps of said hood being folded to form a cover for said tray, said rear panel and said front access panel of said tray each include two fold tabs each secured to one of said two side panels.

12. A carton comprising:

a hood, and a tray, said hood including four panels connected together and four closure flaps, one closure flap extending from a same side of each of said four panels, and a connection tab extending from a side edge of one of said four panels for joining opposite ends of said four panels together, said tray including a base panel and two side panels, a rear panel and a front access panel connected to said base panel and extending above said base panel to define an opening for receipt of a lowermost portion of said hood, said two side panels each include two fold tabs each secured to one of said rear panel and said front access panel.

13. A carton according to claim 12, wherein said front access panel includes a cut-out portion for access to an interior of the tray.

14. A carton according to claim 12, wherein a height of said front access panel is less than a height of said two side panels and said rear panel.

15. A carton according to claim 12, wherein said closure flaps are folded to form a cover for said tray.

16. A carton for shipping, storing and displaying products, said carton comprising:

a hood, and a tray, said hood including four panels connected together and four closure flaps, one closure flap extending from a same side of each of said four panels, and a connection tab extending from a side edge of one of said four panels for joining opposite ends of said four panels together, said tray including a base panel with two side panels, a rear panel and a front access panel secured together and projecting above said base panel, said hood being inserted within said tray to cover any products located on said tray, a lowermost portion of said hood contacting said base panel of said tray and covering an opening of said front access panel, said closure flaps of said hood being folded to form a cover for said tray, said two side panels each include two fold tabs each secured to one of said rear panel and said front access panel.

* * * * *